United States Patent [19]

Landa et al.

[11] Patent Number: 4,980,259

[45] Date of Patent: Dec. 25, 1990

[54] LIQUID DEVELOPER FORMULATION

[75] Inventors: Benzion Landa, Edmonton, Canada; Yaacov Almog; Uri Levy, both of Rehovot, Israel

[73] Assignee: Savin Corporation, Stamford, Conn.

[21] Appl. No.: 301,532

[22] Filed: Jan. 26, 1989

[51] Int. Cl.[5] ..... G03G 9/08; G03G 9/00

[52] U.S. Cl. ..... 430/117; 430/115; 430/137

[58] Field of Search ..... 430/137, 117, 116, 115

[56] References Cited

U.S. PATENT DOCUMENTS 3,900,412 8/1975 Kosel ..... 430/114

FOREIGN PATENT DOCUMENTS 2194044 3/1988 United Kingdom ..... 430/116

*Primary Examiner*—Marion C. McCamish
*Assistant Examiner*—S. Crossan
*Attorney, Agent, or Firm*—Kenyon & Kenyon

[57] ABSTRACT

A process for replenishing a liquid developer, and a liquid developer made by the process, comprising transferring a first composition comprising a carrier liquid and a charge director into the liquid developer and transferring a second composition comprising toner particles, carrier liquid and charge director into the liquid developer. The amount of charge director in each of the first and second compositions charge director is in a predetermined ratio which results in a constant level of charge director in the liquid developer when the liquid developer is utilized in an electrostatic or printing process.

9 Claims, 1 Drawing Sheet

LIQUID DEVELOPER FORMULATION

BACKGROUND OF THE INVENTION

This invention relates to electrostatic printing procedures and more particularly to an improved liquid developer formulation for sustained copy quality.

Processes for forming electrostatic images, existing as electrostatic charge patterns upon a substrate, are well known. In electrostatic printing or copying, a photoconductive imaging surface is first provided with a uniform electrostatic charge, typically by moving the imaging surface past a charge corona at a uniform velocity. The imaging surface is then exposed to an optical image of an original to be copied. This optical image selectively discharges the imaging surface in a pattern to form a latent electrostatic image. In the case of an original bearing dark print on a light background, this latent image consists of substantially undischarged "print" portions corresponding to the graphic matter on the original, admist a "background" portion that has been substantially discharged by exposure to light. The latent image is developed by exposure to oppositely charged, pigmented, toner particles, which deposit on the print portions of the latent image in a pattern corresponding to that of the original.

In liquid developer photocopiers these charged toner particles are dispersed in a dielectric liquid. The dispersion ingredients are carrier liquid, toner particles and charge directors. The charged toner particles in the liquid developer migrate to the oppositely charged "print" portions of the latent image to form a pattern on the photoconductive surface. This pattern, and the corresponding toner particles and residual carrier on the image, and background are then transferred to a sheet to produce a visible image. Any liquid developer remaining on the photoconductive surface after this process is recycled back into the liquid developer reservoir.

Charge directors play an important role in the electrophoretic developing process described above by charging the toner particles in the liquid developer. Stable electrical characteristics of the charged liquid developer are crucial to achieve a high quality image, particularly when a large number of impressions are to be produced without changing the liquid developer solution.

Part of the charge director is adsorbed by the solid toner particles. The overall amount of charge director which remains associated with the solid toner particles via the adsorption mechanism can be determined from an adsorptivity analysis. Details of the analysis techniques will be discussed in a following paragraph.

The quantity of toner particles utilized per photocopy will vary in proportion to the percentage of "print" portions in the original while the amount of carrier liquid transferred increases more slowly as a function of print portion. An original containing a large "print" portion will cause a greater depletion of the toner particles than an original containing a "small" print portion. Thus substantially white originals, i.e. paper containing few covered areas will cause less relative depletion of toner particles. Substantially dark originals, i.e. originals containing numerous graphic images or letter copy, will cause greater relative depletion of toner particles.

The application of liquid developer to the photoconductive surface depletes the overall amount of liquid developer in the developer reservoir. Generally the reservoir is replenished from two separate sources, the first containing carrier liquid and the second containing a highly concentrated dispersion of toner particles in carrier liquid. The charge director is generally added with either the carrier liquid or the toner particle dispersion but not with both. The rate of replenishment of carrier liquid is controlled by monitoring the overall amount of the liquid developer. The rate of replenishment of toner particles is controlled by monitoring the concentration of toner particles in the liquid developer, by optical sensing. Thus, toner particle concentration in the liquid developer dispersion remains relatively constant. However, since charge director is generally added either with the carrier liquid or the concentrated toner particle dispersion but not with both, the charge director concentration in the liquid developer will not remain constant during substantial operation at different copy coverages causing a charge director imbalance in the liquid developer reservoir.

We have discovered that many low quality copies are a result of this charge director imbalance in the liquid developer. The optimum charge director concentration in the liquid developer is usually determined to be the concentration which will achieve high copy quality in copies made from originals having some nominal print area. As previously discussed, the amount of toner particles utilized per photocopy varies in proportion to the "print" area of the original. A large number of originals with small "print" areas (hereinafter "white" copies) will result in very little utilization of toner particles. However, since the total amount of liquid developer utilized per copy varies more slowly with print area, a large number of white copies will deplete the overall amount of liquid developer. In response carrier liquid will be added to the liquid developer reservoir. The amount of carrier liquid added to the reservoir will be much greater than amount of toner particle dispersion since the white copies utilized very few toner particles. If the photocopier is designed so that the charge director is added only with the carrier liquid, the result of a large number of white copies will be an increase in the concentration of the charge director in the liquid developer. The increased concentration of charge director above the optimal value will result in a lower than optimal dispersion of toner particles. The result will be a degradation of copy quality. If the photocopier is designed so that the charge director is added only with the toner particle solution, the result of a large number of white copies will be a decrease in the concentration of charge director in the liquid developer. This decreased concentration will also adversely affect the copy quality.

Similarly, a large number of originals with high "print" areas (hereinafter "black" copies) will cause a degradation of copy quality. Producing the black copies will deplete the number of toner particles in the liquid developer resulting in the addition of concentrated toner particle dispersion to the liquid developer reservoir. If charge director is added with the toner particle dispersion, the concentration of charge director in the liquid developer will be increased. Thus a greater than optimal concentration of charge director will occur resulting in degraded copies. If charge director is added with the carrier liquid, black copies will reduce the concentration of charge director in the liquid developer. This less than optimal concentration of charge director will result in degradation of copy quality.

The optimum solution to the problem of charge director imbalance in the liquid developer would be to separately monitor the charge director concentration in the liquid developer and add charge director to the liquid developer reservoir separately from either the toner particle solution or the carrier liquid. This solution, though possible, would involve the use of costly conductivity or other measurement devices and additional replenishment mechanisms. These devices and mechanisms are impractical in many situations especially as additions to existing photocopier designs.

A simpler solution is needed.

It is accordingly one object of the present invention to provide a solution to the problem of charge director imbalance in liquid developer to provide sustained high quality copies from originals with varying print areas thereby overcoming or otherwise mitigating the problems inherent in photocopying processes known to the art.

Another object of the present invention is to provide a new electrostatic photocopying process whereby charge directors are added to the liquid developer reservoir with both the carrier liquid and the concentrated toner particle dispersion.

A further object of the present invention is to provide a mathematical equation to allow for the calculation of the correct ratio of charge director associated with the carrier liquid and the concentrated toner particle dispersion.

A still further object of the present invention is to provide a new electrostatic photocopying process whereby charge directors are associated with both the carrier liquid and the concentrated toner particle dispersion in a ratio which allows the charge director concentration in the liquid developer to remain relatively constant, regardless of the percentage of print areas on the originals to be copied, thereby producing sustained high quality copies from originals with varying percentages of print areas.

Other objects and advantages of the present invention will become apparent in the following description of the invention.

SUMMARY OF THE INVENTION

Our invention comprises a liquid developer formulation having a relatively constant level of charge director for use in an electrostatic photocopying or printing process. Calculating the correct ratio of charge director associated with the carrier liquid and with the concentrated toner particle dispersion in the liquid developer per our invention, allows each to contain the appropriate fraction of charge director to enable the liquid developer system to be equilibrius at all copy conditions. In our invention the charge director consumption of white copy is satisfied by the charge director in the carrier liquid and the charge director consumption of black copy is in proportion to the toner particles to liquid developer ratio of the liquid developer.

DETAILED DESCRIPTION OF THE INVENTION

Figure 1:
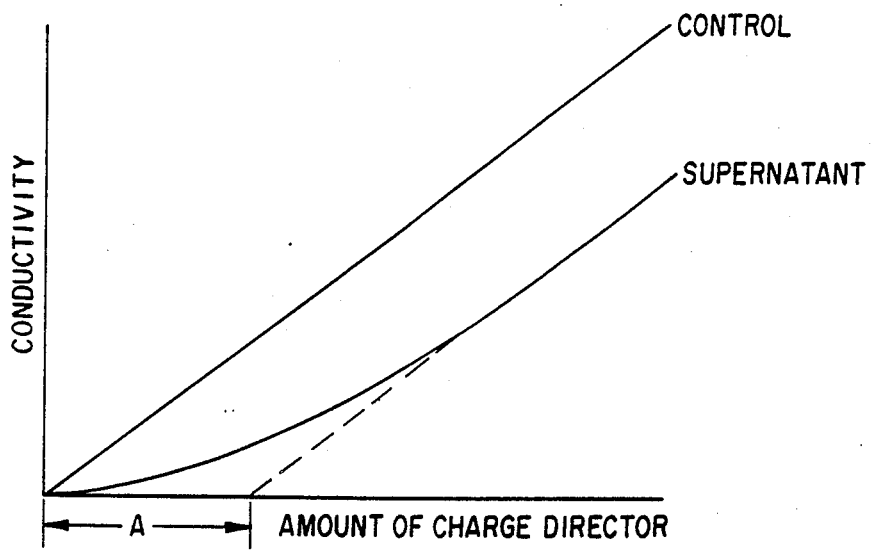

We have derived a formula to determine the correct amount of charge director required for the concentrated toner particle dispersion and for the carrier liquid. In order to use the formula a constant of the liquid developer solution must be determined. This constant "K" reflects the amount of charge director associated via the adsorption mechanism with the toner particles. Our formula relates this constant and the variables of liquid developer formulation. This formula is used to determine the correct amount of charge director required for the toner particle concentrate addition and for the dispersant addition.

The formula for the correct amount of charge director in the concentrated toner particle dispersion is:

$$C=SK+ID$$

where,

C=amount of charge director (in milligrams (mg))

S=weight of the toner particles (in grams (g))

K=a constant for each production batch of toner which reflects the amount, by weight, of charge director associated with the solid phase (in mg/g)

I=weight of carrier liquid in the liquid developer system (in g)

D=amount, by weight, of charge director per gram carrier liquid (in the carrier liquid) (in mg/g) The equation for calculating the correct amount of charge director in the carrier liquid is:

$$A=DL$$

where,

A=the amount, by weight, of charge director in the carrier liquid (in mgs)

D=is the same as for the previous formula

L=the amount, by weight, of carrier liquid (in g) In order to determine the above relations K, and D must be known.

K is determined via an adsorption analysis for each production batch of toner to be utilized in the liquid developer. One way of performing this analysis is by constructing a graph which plots conductivity per amount of charge director. First, a calibration curve is constructed by measuring the conductivity of different charge director solutions which do not contain toner particles.

Next, a specific amount of charge director is added to the toner particle dispersion. Usually between 0–100 mgs of charge director is added per gram of toner particles in the dispersion. The charge director-toner particle dispersion is then set aside and left to equilibrate for about 24 hours. The equilibrated dispersion is then centrifuged at approximately 10,000 rpm for 15 minutes and the conductivity of the resulting supernatant is measured.

The conductivity of the supernatant per amount of charge director added to the toner particle dispersion is then plotted on the graph containing the previously constructed calibration curve. The process is then repeated with a new amount of charge director being added to the toner particle dispersion to generate a supernatant curve on the graph.

The difference between the amount of charge director required to reach a given conductivity for the two cases, namely the supernatant case and the control (no toner) case reflects the amount of charge director associated with the toner particles and is indicated by A on FIG. 1. To find the value K required for the above equations the value A should be divided by the weight of toner solids in the dispersion. D is experimentally derived using the following formula:

$$D=(T-KS)/(I+L)$$

where,

T = the total amount, by weight, of charge director in an optimum liquid developer (in mg). To determine T a working dispersion of the liquid developer is prepared and charge director is added until optimum performance is determined. In practice the working dispersion is placed in the liquid developer reservoir of a photocopier and a copy is made. The copy produced is inspected for copy quality. If the copy quality is unacceptable, a small amount of charge director, approximately 20 mg, is added to the liquid developer in the reservoir and another copy is made. This copy is then inspected for copy quality. If copy quality is unacceptable another 20 mg of charge director is added to the liquid developer. This process continues until optimal copy quality is produced. It should be noted that persons with ordinary skill in the art will add a amount of charge director greater than 20 mg towards the beginning of this process and will add an amount of charge director less than 20 mg towards the end of this process. The weight of each of the materials in the liquid developer is then recorded.

EXAMPLE

A working dispersion of liquid developer is prepared with 1477.5 grams Isopar-H (a trademarked isomerized aliphatic hydrocarbon of Exxon Corporation) and 22.5 grams of solid toner particles. Using the formula of this invention the dispersion is analyzed for adsorptivity to determine K=4.4 mg/g. Using the process described above it is found that 409.5 mg of charge director resulted in optimum copy quality. Thus T, the total amount of charge director in mg in an optimum dispersion, equals 409.5. From this information D can be calculated as follows:

$$D=(T-KS)/(I+L)$$

S=22.5 g of solid $I+L$=1477.5 g of liquid

T=409.5 mg

K=4.4 mg/g Therefore $D=(409.5-(4.4\times 22.5))/1477.5=0.21$ *mg/g* and to maintain charge director equilibrium the concentration of charge director to carrier liquid must be 0.21 mg/g of dispersant. Thus 210 mg of charge director must be added to each kg of dispersant.

From this information the correct amount of charge concentrate (C) to be placed in the toner particle solution in the photocopier can be calculated. As shown in the preceding section, $C=SK+ID$. A 1 kg toner concentrate containing 7.5% solids is prepared and C is calculated as follows:

$$K = 4.4 \text{ mg/g}$$
$$D = 0.21 \text{ mg/g}$$
$$S = 7.5\% \times 1 \text{ kg} = 75 \text{ g}$$
$$I = 1 \text{ kg} - S = 925 \text{ g}$$
$$C = 75 \times 4.4 + 0.21 \times 925 = 524.2 \text{ mg}$$

Thus 524.2 mg of charge director are added to the toner particle concentrate. The end result is a liquid developer which will maintain a stable level of charge director during photocopying of originals with varying print areas.

It should be understood that the foregoing description if for the purpose of illustration only and that the invention includes all modifications falling within the scope of the following claims.

We claim:

1. A process for replenishing a liquid developer comprising transferring a first composition comprising a carrier liquid and a charge director into said liquid developer in response to a measurement of the overall amount of said liquid developer and transferring a second composition comprising toner particles, a carrier liquid and a charge director into said liquid developer in response to a measurement of toner particles in said liquid developer.

2. The process of claim 1 wherein said charge director is present in said first composition and said second composition in a predetermined ratio.

3. The process of claim 2 wherein said predetermined ratio results in a constant level of charge director in said liquid developer when said liquid developer is utilized in an electrostatic photocopying or printing process.

4. The process of claim 2 wherein said charge director is in said second composition in an amount determined according to the following formula:

$$C=SK+ID$$

where,

C = amount of charge director in said second composition (in milligrams)

S = weight of the toner particles (in grams)

K = a constant for each production batch of toner particles representing the amount of said charge director associated, via an adsorption mechanism, with said toner particles (in milligrams per gram)

I = weight of carrier liquid in the liquid developer system (in grams), and

D = amount, by weight, of charge director per gram carrier liquid in said carrier liquid (in milligrams per gram).

5. The process of claim 4 wherein the amount of charge director in said first composition is determined according to the following formula:

$$A=DL$$

where,

A = amount, by weight, of charge director in said first composition (in milligrams)

D = amount, by weight, of charge director per gram carrier liquid in said carrier liquid (in milligrams per gram)

L = amount, by weight, of said carrier liquid (in grams).

6. The process of claim 5 wherein K is determined by an adsorption analysis and D is experimentally derived according to a formula $D=(T-KS)/(I+L)$ where T = total amount by weight of charge director in an optimum liquid developer (in milligrams).

7. A process for replenishing a liquid developer comprising forming a liquid developer composition by mixing a first composition comprising a carrier liquid and a charge director in an amount responsive to a measurement of the overall amount of said liquid developer and a second composition comprising toner particles, a carrier liquid and a charge director in an amount responsive to a measurement of toner particles in said liquid developer.

8. The process of claim 7 wherein said charge director in said first composition and said charge director in said second composition are present in a predetermined ratio.

9. The process of claim 7 wherein said predetermined ratio results in a constant level of charge director in said liquid developer where said liquid devloper is utilized in an electrostatic photocopying process.

* * * * *